United States Patent [19]

Maxian et al.

[11] Patent Number: 4,463,508

[45] Date of Patent: Aug. 7, 1984

[54] BACKFILL COMPACTOR

[76] Inventors: Paul Maxian, P.O. Box 280, Ringoes, N.J. 08551; Joseph Maxian, P.O. Box 507, Yardley, Pa. 19067

[21] Appl. No.: 465,278

[22] Filed: Feb. 9, 1983

[51] Int. Cl.[3] ..... E02F 5/22

[52] U.S. Cl. ..... 37/142.5; 37/195; 404/133; 405/179

[58] Field of Search ..... 37/142.5, 195; 404/133; 405/179, 157

[56] References Cited

U.S. PATENT DOCUMENTS

| | | | |
|---|---|---|---|
| 975,457 | 11/1910 | Ransome | 37/142.5 |
| 3,201,948 | 8/1965 | Schramm | 37/142.5 X |
| 3,807,067 | 4/1974 | Cloud | 37/142.5 |
| 3,908,292 | 9/1975 | Harris | 37/142.5 |
| 3,930,741 | 1/1976 | Berry | 404/133 |
| 4,028,902 | 6/1977 | Courson et al. | 405/179 X |

*Primary Examiner*—Clifford D. Crowder
*Attorney, Agent, or Firm*—Ruth Moyerman

[57] ABSTRACT

A compactor for use in compacting the backfill in trenches is disclosed. A rigid ramp, the width of a trench, has an angular foot and is fitted with vibratory plates. The device is placed in a trench, backfill is loaded into the trench from behind the ramp, and the ramp vibrated to compact the fill across the entire width, depth and length of the ramp in a continuous operation. The device may be reinforced, if required, and also includes a supplemental weight distributor fastened above its vibratory plates.

7 Claims, 3 Drawing Figures

BACKFILL COMPACTOR

BACKGROUND OF THE INVENTION

1. Field of the Invention

This invention relates to road and earth compaction, and especially to the tamping of backfill such as gravel in trenches.

2. Description of the Prior Art

Laying pipe or conduit into trenches is a necessary step in much of the construction trade. Such trenches must then be backfilled with aggregate such as gravel, and the aggregate compacted. Compacting the aggregate has heretofore been done by a worker standing unprotected inside the trench. Often he is exposed to the danger of the 8–15 foot deep trench caving in on him. Additionally, he is exposed to the sliding gravel as it is dumped into the trench.

In terms of work efficiency, conventional trench filling is poor. The individual worker, with a hand-held mechanical wacker, compacts the backfill by layers. Since the wacker can compact only a few inches of backfill at a time and since the area tamped is only as large as the hand-held tamper itself, the compaction process is time consuming. Since each operator works differently, the process is further lengthened by the need for frequent testing to see if the desired density of backfill has been achieved.

There is, therefore, a need for a compacting device which is safe to use, and which removes the operator from the interior of the trench and from exposure to cave-in. There is an additional need for a backfill compact which allows continuous compaction of an entire depth and width of a trench.

SUMMARY OF THE INVENTION

The aforementioned prior art problems are obviated by the backfill compactor of this invention. In the preferred embodiment of the invention, a vibrating ramp device, preselected by size to correspond to the width of the trench to be filled, is of a length predetermined to exceed the depth of the trench so that a protruding end results.

In use, the outwardly extending ramp end is used as a guide to dump aggregate behind the vibrating ramp. A loading device such as a loader, lifts the outward extended ramp end with its bucket and dumps the aggregate behind the ramp. Simultaneously with the dumping, the aggregate is compacted by the vibrating action of the ramp. Vibrating is produced, for example, by means of a pneumatic vibrator mounted on the ramp and driven by compressed air. The ramp should be of generally the same width as the trench, thus the ramp may compact an entire width of the trench at one time. The total trench depth is compacted by virtue of the ramp extending the full depth of the trench.

As the aggregate is compacted, the pressure of the backfill behind the ramp in combination with the vibrating of the ramp causes the ramp to move automatically lengthwise along the ramp on its angular foot, e.g. "walk". This movement along the trench floor allows continuous compaction of the entire trench length.

The device, in an alternate embodiment, may be made more efficient by the addition of an inverted U-shaped supplementary weight distributor. This supplemental weight distributor is attached to the ramp across its width near the vibrating device, providing additional pressure to the ramp. Also, when the bucket of the loading device is rested on top of the supplemental weight distributor, an increased even and measured impact is delivered to the ramp.

It is, therefore, an object of this invention to provide a device which allows safe trench filling by eliminating the need for a worker to be in the trench during the operation.

It is another object of this invention to provide a device which compacts a greater area of aggregate at one time than is now possible.

It is still another object of this invention to provide a device which will compact a trench in all dimensions -- depth, length and width -- in a continuous process.

It is yet a further object of this invention to provide a device which can operate with air pressure supplied by a standard construction site compressor or other conventional vibrating means.

These and other objects will be more readily ascertainable to one skilled in the art from a consideration of the following Figures, descriptions and exemplary embodiments.

BRIEF DESCRIPTION OF THE DRAWING(S)

DETAILED DESCRIPTION OF THE PREFERRED EMBODIMENT(S)

Figure 1:
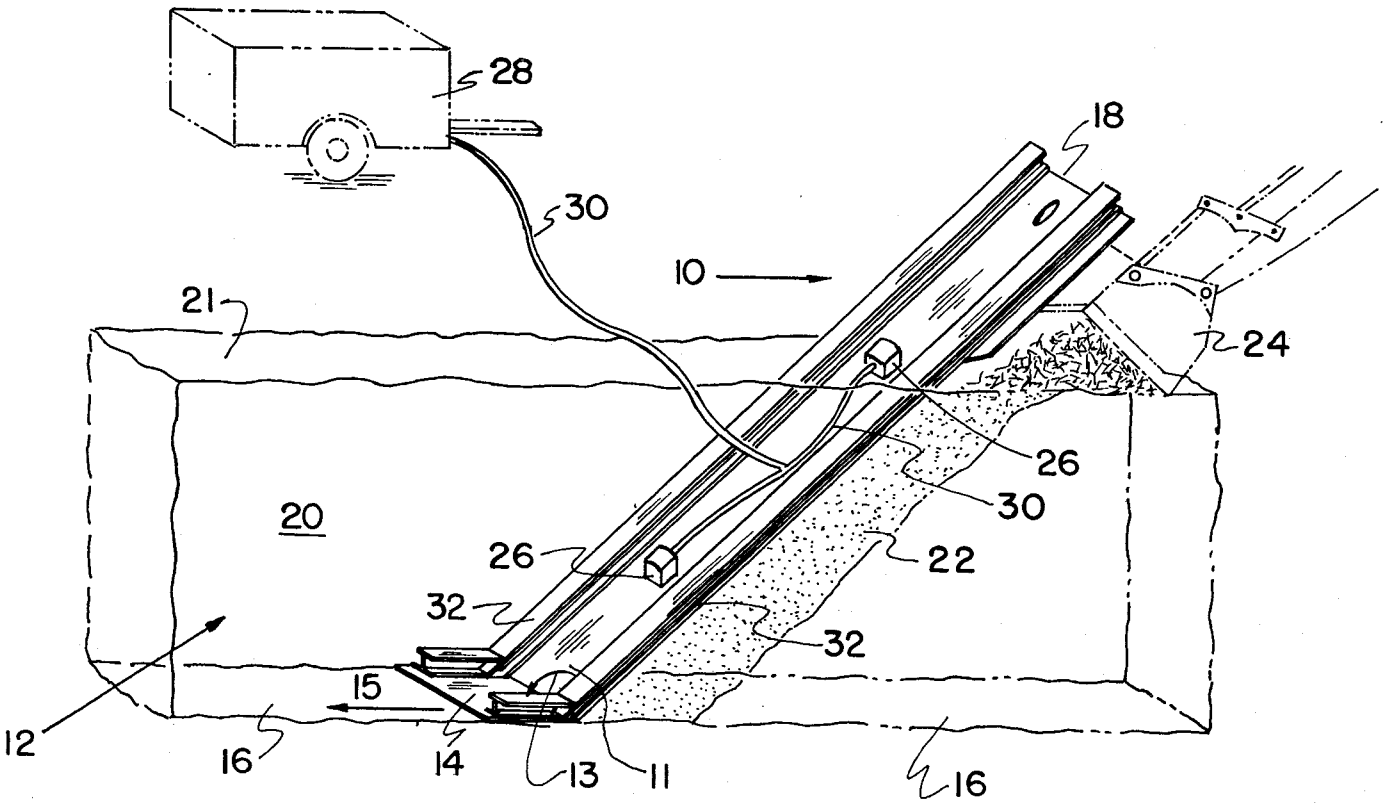
FIG. 1 depicts the device of this invention in use in a trench, the trench shown in phantom.

Referring now to the drawings, and more particularly to FIG. 1, the device is illustrated as it would appear in use on a construction site. the entire ramp, generally 10, is shown in place within trench 12 including angular foot 14 forming obtuse angle 13 with upward face 11 of ramp 10 resting on floor 16 of trench 12.

Ramp 10 is in trench 12 with its protruding end 18 extending above rim 21 of wall 20 of trench 12. Simultaneously lifting end 18 and dumping aggregate 22 into trench 12 is bucket 24 of a conventional loader. After aggregate 22 is dumped behind ramp 10, bucket 24 is removed and ramp 10 rests angularly against gravel 22. Vibrators 26, fed compressed air from compressor 28 through air hoses 30, compact aggregate 22 firmly into trench 12 across its entire width and depth.

As the depth of trench 12 is filled with aggregate 22, ramp 10 will "walk" in the direction of arrow 15 along floor 16. "Walking" is possible because foot 14 is attached to ramp 10 at an obtuse angle, indicated by arrow 13, and thus will not dig into floor 16.

For reinforcing strength, elongated reinforcing sides 32, shown as I-beams, may be optionally fastened to ramp 10.

Figure 2:
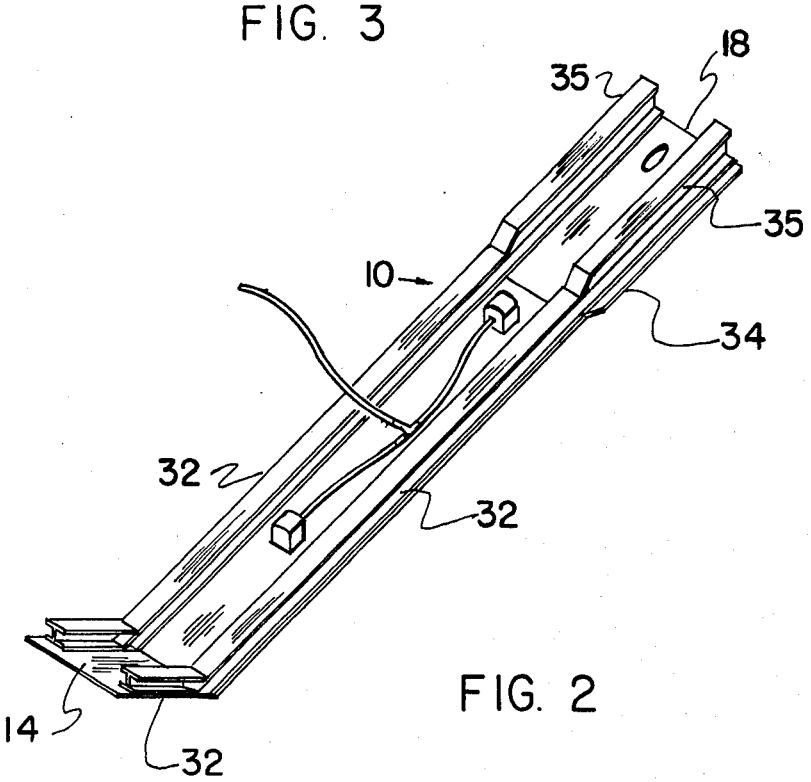
FIG. 2 is an elevation of the preferred embodiment of this invention.

Referring now to FIG. 2, ramp 10 is shown having foot 14, protruding end 18 and sides 32. Sides 32 on length of ramp 10 and on foot 14 are shown as I-beams in the preferred embodiment. Sides 32 offer increased weight and strength by reinforcing ramp 10 along its entire length. Additional reinforcement is provided to protruding end 18 of ramp 10 by the addition of plate 34 across the width of ramp 10 and extending beyond sides 32 of ramp 10.

Plate 34 offers reinforcement to that area which is in contact with loading bucket 24 (shown in FIG. 1).

When bucket 24 is removed from the underside (not shown) of ramp 10, ramp 10 falls back onto aggregate (shown in FIG. 1) with considerable force, thus the additional reinforcement of plate 34 may be desired.

Also in FIG. 2, sides 32 are shown having additonal reinforcement 35 at protruding end 18. Such reinforcement helps protect ramp 10 from the effects of jarring when bucket 24 (shown in FIG. 1) is removed. Additionally, plate 34 and side reinforcement 35 increase the weight of ramp 10, thus increasing its ability to compact at a faster rate.

Figure 3:
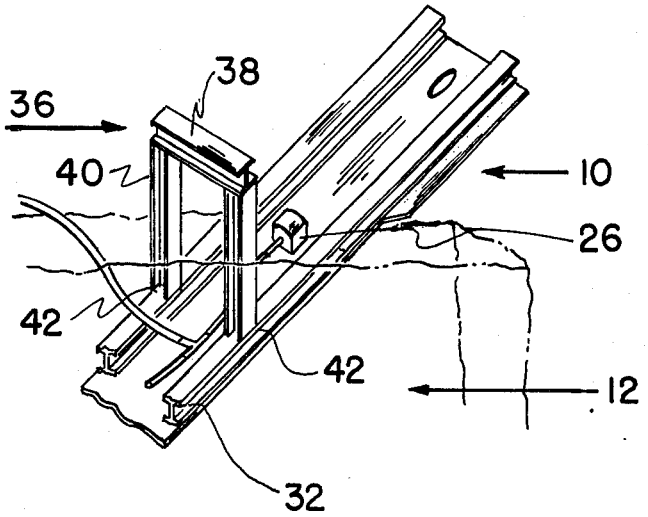
FIG. 3 is a cutaway of an alternate embodiment of the ramp of this invention, the trench again shown in phantom.

Referring now to FIG. 3, ramp 10 placed in trench 12 is shown with inverted U-shaped supplemental weight distributor 36, having sides 40 attached at points 42 to sides 32 of ramp 10. Supplemental weight distributor 36 is fastened to ramp 10 near pneumatic vibrators 26 to supply additional weight to that area of ramp 10. Also, when in use, bucket 24 (shown in FIG. 1) may be rested on top 38 of supplemental weight distributor 36 to deliver an even and measured impact to ramp 10. The additional weight and impact provided by the combination of supplemental weight distributor 36 and bucket 24 increases the efficiency of ramp 10.

There are many variations which may be practiced within the scope of this invention. Reinforcing sides 32 are shown as I-beams, but a length of any rigid support may be used.

Plate 34 is shown extending outward from sides 32, but such width is not necessary and plate 34 may be eliminated entirely. Reinforcement 35 of sides 32 may also be eliminated in favor of another method of reinforcement.

It should be noted that pneumatic vibrators 26 driven by compressor 28 are only one way of producing the vibrating action required to compact aggregate 22. Any other means which will achieve this effect may be substituted.

There are many advantages to the backfill compactor of this invention. Chiefly, the device allows a trench to be filled safely. The operator is not inside the trench as it fills and is out of danger in case of cave-in.

Secondly, because the trench is filled and compacted across an entire width and depth of trench at one time, a faster completion of backfill is now possible.

Also, because foot 14 is angled, it can walk along floor 16 of trench 12, allowing a continuous backfill operation.

With the addition of inverted U-shaped supplemental weight distributor 36, proper compaction to desired density at various requirement levels is possible.

The vibrating ramp of this invention is a distinct improvement over the presently used hand-held wackers in that it can compress a much greater area at one time and can do so safely.

Having now illustrated and described my invention, it is not intended that such description limit this invention, but rather that this invention be limited only by a reasonable interpretation of the apended claims.

What is claimed is:

1. A device to tamp aggregate in a trench or the like earth furrow as the device progressively moves in a forward direction comprising:

(a) a rigid, generally rectangular ramp of a width predetermined to fit within a trench at an inclined rearward direction said ramp having an upwardly facing surface and a downwardly facing surface and two sides which, in use, juxtapose with walls of said trench and two ramp ends, one end of a length predetermined to allow it to protrude from said trench, said upwardly protruding end serving as a guide for backloading of aggregate against the downwardly facing surface of said ramp, (b) a rigid, angular foot having a top surface and a bottom surface and attached to said ramp's other end at an obtuse angle in respect to the upwardly facing surface of said ramp, said foot extending from said ramp in the direction of forward progress so as to rest it bottom surface on saidtrench floor; and, (c) means for causing vibration of said ramp so that when said ramp rests against aggregate placed behind and under said ramp in said trench, said trench, said aggregate vibrates and compacts to fill a predetermined depth and width of a trench in one continuous operation.

2. The ramp according to claim 1 wherein said means for causing vibration of said ramp comprises at least one pneumatic vibrator.

3. The ramp according to claim 1 including, additionally, an inverted U-shaped supplementary weight distributor attached at said U's ends to said ramp across its width proximate said vibration means so that when a loading device is rested on said supplementary weight distributor, an even and measured impact is delivered to said ramp.

4. The ramp according to claim 1 including, additionally, elongated reinforcing means fastened to said lengthwise sides of said ramp.

5. The ramp according to claim 1 including, additionally, reinforcing means extending across said width of said ramp proximate said ramp's protruding end.

6. The ramp according to claim 4 wherein said reinforcing means are I-beams.

7. A method for filling a trench with aggregate in a continuous operation comprising:

(a) placing a footed, elongated ramp lengthwise into a trench and inclined rearwardly with respect to the direction of forward progress with said ramp sides in juxtaposition with both trench walls simultaneously, and with the upper end of the ramp protruding from said trench; said footed end of said ramp extending to said trench's floor with its foot forming an obtuse angle with the upwardly facing ramp surface and extending from said ramp in the direction of forward progress such that the bottom surface of the foot rests on the trench floor;

(b) lifting said protruding end;

(c) depositing an aggregate behind and under said ramp in said trench;

(d) setting said ramp against said aggregate;

(e) vibrating said ramp so that simultaneously said aggregate is continuously compacted in vertical and horizontal planes as said ramp is walked forward in said trench; and, (f) repeating steps b through (e) until said trench is filled to a desired height, width and depth.

* * * * *

UNITED STATES PATENT AND TRADEMARK OFFICE

CERTIFICATE OF CORRECTION

PATENT NO. : 4,463,508

DATED : August 7, 1984

INVENTOR(S) : Maxian, et al

It is certified that error appears in the above-identified patent and that said Letters Patent are hereby corrected as shown below:

Column 4 line 8 following the word ramp, delete the "," and substitute therefor -- ; --.

Column 4 line 14 following the word rest, delete the word "it" and substitute therefor -- it's --.

Column 4 line 14 following the word said, insert a space.

Column 4 lines 18 and 19 following the word trench, delete the words "said trench".

Column 4 line 62 following the word steps, delete the "b" and substitute therefor -- (b) --.

Signed and Sealed this

*Tenth* Day of *December 1985*

[SEAL]

*Attest:*

DONALD J. QUIGG

*Attesting Officer*

*Commissioner of Patents and Trademarks*